US008522733B2

(12) United States Patent
Hoppe et al.

(10) Patent No.: US 8,522,733 B2
(45) Date of Patent: Sep. 3, 2013

(54) DEVICE FOR VARIABLY ADJUSTING CONTROL TIMES OF GAS EXCHANGE VALVES OF AN INTERNAL COMBUSTION ENGINE

(75) Inventors: Jens Hoppe, Erlangen (DE); Andreas Roehr, Heroldsbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 186 days.

(21) Appl. No.: 12/746,266

(22) PCT Filed: Nov. 24, 2008

(86) PCT No.: PCT/EP2008/066065

§ 371 (c)(1),
(2), (4) Date: Aug. 31, 2010

(87) PCT Pub. No.: WO2009/071457

PCT Pub. Date: Jun. 11, 2009

(65) Prior Publication Data

US 2011/0174253 A1 Jul. 21, 2011

(30) Foreign Application Priority Data

Dec. 5, 2007 (DE) ..... 10 2007 058 491

(51) Int. Cl.
*F01L 1/34* (2006.01)

(52) U.S. Cl.
USPC ..... 123/90.15; 123/90.17

(58) Field of Classification Search
USPC ..... 123/90.15, 90.17
See application file for complete search history.

(56) References Cited

U.S. PATENT DOCUMENTS

| | | | | |
|---|---|---|---|---|
| 6,684,835 | B2 | 2/2004 | Komazawa et al. | |
| 6,779,500 | B2 | 8/2004 | Kanada et al. | |
| 8,006,660 | B2 * | 8/2011 | Strauss et al. | 123/90.17 |
| 8,047,170 | B2 * | 11/2011 | Strauss et al. | 123/90.17 |
| 2003/0033999 | A1 | 2/2003 | Gardner et al. | |
| 2003/0196617 | A1 | 10/2003 | Simpson et al. | |
| 2004/0055550 | A1 * | 3/2004 | Smith | 123/90.17 |
| 2005/0016481 | A1 * | 1/2005 | Komazawa et al. | 123/90.17 |
| 2006/0016495 | A1 * | 1/2006 | Strauss et al. | 137/625.65 |
| 2007/0035315 | A1 * | 2/2007 | Hilleary | 324/700 |
| 2007/0056540 | A1 * | 3/2007 | Hoppe et al. | 123/90.17 |
| 2007/0095315 | A1 * | 5/2007 | Hoppe et al. | 123/90.17 |
| 2007/0169730 | A1 * | 7/2007 | Kohrs et al. | 123/90.17 |

FOREIGN PATENT DOCUMENTS

| | | | |
|---|---|---|---|
| DE | 39 37 644 | A | 5/1991 |
| DE | 198 17 319 | A | 10/1999 |
| DE | 198 48 706 | A | 4/2000 |
| DE | 103 46 443 | A | 5/2005 |
| DE | 10 2006 020320 | A | 11/2007 |

(Continued)

*Primary Examiner* — Thomas Denion
*Assistant Examiner* — Steven D Shipe
(74) *Attorney, Agent, or Firm* — Lucas & Mercanti, LLP

(57) ABSTRACT

A device for variably adjusting control times of gas exchange valves of an internal combustion engine. The device has a drive element, an output element, a rotation angle limiting device and a control valve and counter-working pressure chambers are also provided. Phase adjustment between the output and drive element is initiated by applying pressure to one pressure chamber while discharging the other pressure chamber. The rotation angle limiting device can be locked or unlocked to prevent or allow phasing. The control valve has a valve housing and a control piston. An inflow connection, an outflow connection, a control connection and two working connections are embodied on the valve housing.

11 Claims, 5 Drawing Sheets

(56) References Cited

FOREIGN PATENT DOCUMENTS

| | | | |
|---|---|---|---|
| EP | 1 286 023 | A | 2/2003 |
| EP | 1 752 691 | A | 2/2007 |
| GB | 2 432 645 | A | 5/2007 |
| WO | 03078804 | A | 9/2003 |
| WO | WO 2006043716 | A1 * | 4/2006 |
| WO | WO 2007039399 | A1 * | 4/2007 |

* cited by examiner

DEVICE FOR VARIABLY ADJUSTING CONTROL TIMES OF GAS EXCHANGE VALVES OF AN INTERNAL COMBUSTION ENGINE

This application is a 371 of PCT/EP2008/066065 filed Nov. 24, 2008, which in turn claims the priority of DE 10 2007 058 491.3 filed Dec. 5, 2007, the priority of both applications is hereby claimed and both applications are incorporated by reference herein.

FIELD OF THE INVENTION

The invention relates to a device for variably adjusting the timing control of gas exchange valves of an internal combustion engine, comprising a drive element, an output element, a rotation angle limiting device and a control valve, at least two counter-working pressure chambers being provided, it being possible to bring about a phase adjustment between the output element and the drive element by charging one of the pressure chambers with pressure medium while simultaneously discharging the other pressure chamber, the rotation angle limiting device preventing the phase relation from being altered when in a locked state and the rotation angle limiting device allowing the phase relation to be altered when in an unlocked state, it being possible to switch the rotation angle limiting device from the locked to the unlocked state by charging same with pressure medium, the control valve comprising a valve housing and a control piston, exactly one inflow port, at least one outflow port, one control port and two working ports being embodied on the valve housing, the inflow port being connected to a pressure source, the outflow port to a tank, the control port to the rotation angle limiting device and the working ports each being connected to a respective pressure chamber, and the control valve being arranged in a central receptacle of the output element.

BACKGROUND OF THE INVENTION

In modern internal combustion engines, devices for variably adjusting the timing control of gas exchange valves are used to configure the phase relation between crankshaft and camshaft variably between a maximum advance and a maximum retard position within a defined angular range. For this purpose the device is integrated in a drive train via which torque is transmitted from the crankshaft to the camshaft. This drive train may be implemented, for example, as a belt drive, chain drive or gear drive.

The device includes at least two counter-rotatable rotors, one rotor being in driving connection to the crankshaft and the other rotor being connected non-rotatably to the camshaft. The device includes at least one pressure chamber which is subdivided into two counter-working pressure chambers by means of a movable element. The movable element is operatively connected to at least one of the rotors. By supplying pressure medium to the pressure chambers or discharging pressure medium from the pressure chambers, the movable element is displaced within the pressure chamber, whereby a specified rotation of the rotors with respect to one another, and therefore of the camshaft with respect to the crankshaft, is effected.

The inflow of pressure medium to the pressure chambers and the discharge of pressure medium therefrom is controlled by means of a control unit, as a rule a hydraulic directional valve (control valve). The control unit is in turn controlled by means of a controller which determines the actual and reference position of the camshaft relative to the crankshaft (phase relation) with the aid of sensors and compares one to the other. When a difference between the two positions is detected, a signal is transmitted to the control unit which adapts the flows of pressure medium to the pressure chambers to this signal.

In order to ensure the functioning of the device, the pressure in the pressure medium circuit of the internal combustion engine must exceed a given value. Because the pressure medium is as a rule made available by the oil pump of the internal combustion engine and the available pressure therefore rises synchronously with the rotational speed of the internal combustion engine, below a given rotational speed the oil pressure is still too low to change or retain the phase relation of the rotors in a specified manner. This may be the case, for example, during the start phase of the internal combustion engine or during idling phases.

During these phases the device would execute uncontrolled oscillations, leading to increased noise emissions, greater wear, more uneven running and increased raw emissions of the internal combustion engine. In order to prevent this, there may be provided mechanical locking devices which couple the two rotors non-rotatably to one another during the critical operating phases of the internal combustion engine, it being possible to cancel this coupling by charging the locking device with pressure medium. In this case the locking position may be provided at one of the end positions (maximum advance position and maximum retard position) or between the and positions.

A device of this type is known, for example, from U.S. Pat. No. 6,684,835 B2. In this embodiment the device has a vane-cell construction, an outer rotor being mounted rotatably on an inner rotor in the form of a vane wheel. In addition, two rotation angle limiting devices are provided, a first rotation angle limiting device, when in the locked state, allowing the inner rotor to be adjusted with respect to the outer rotor within an interval between a maximum retard position and a defined central position (locking position). The second rotation angle limiting device, when in the locked state, allows the inner rotor to be rotated with respect to the outer rotor within an interval between the central position and the maximum advance position. When both rotation angle limits are in the locked position, the phase relation of the inner rotor to the outer rotor is limited to the central position.

Each of the rotation angle limiting devices consists of a spring-loaded locking pin which is arranged in a receptacle of the outer rotor. Each locking pin is loaded with a force in the direction of the inner rotor by means of a spring. A guide track, which is located opposite the locking pins in certain operating positions of the devices, is formed on the inner rotor. In these operating positions the pins can engage in the guide track. In this case the respective rotation angle limiting device is switched from the unlocked to the locked state. Each of the rotation angle limiting devices can be switched from the locked to the unlocked state by charging the guide track with pressure medium. In this case the pressure medium forces the locking pins back into their receptacles, whereby the mechanical coupling of the inner rotor to the outer rotor is cancelled.

The charging of the pressure chambers and the guide track with pressure medium is effected by means of a control valve, two working ports which communicate with the pressure chambers, and a control port which communicates with the locking groove, being formed, inter alia, on the control valve. Further control valves of this type are known from U.S. Pat. No. 6,779,500 B2. These control valves consist essentially of a conventional 4/3-way directional-proportional control valve which directs the pressure medium flows to and from the pressure chambers, and a 2/2-way directional control valve which controls the flows of pressure medium to and from the rotation angle limiting devices, the part-valves being arranged in series. In this case the two part-valves have a common control piston and a common valve housing.

A disadvantage of these embodiments is the large space requirement of the control valve, above all in the axial direction of the valve housing. In addition, the high number of control structures, which have to be formed on the control piston, is disadvantageous. This entails increased cost and increased space requirement. A further disadvantage is that these control valves are not suited to being used as a central valve which is arranged in a central receptacle of the inner rotor. Firstly, the control valves have two inflow ports to which pressure medium must be supplied via the inner rotor of the device. This increases the complexity and susceptibility to error of the device. Furthermore, the device must be constructed wide in the axial direction in order that all five ports of the valve are covered by the receptacle of the inner rotor. This entails increased cost in manufacturing the device. In addition, the space requirement and weight thereof are increased.

OBJECT OF THE INVENTION

It is the object of the invention to specify a device for variably adjusting the timing control of gas exchange valves of an internal combustion engine with a control valve, whereby a construction of the control valve as simple and cost-effective as possible is to be achieved. In addition, the space requirement of the control valve is to be minimized.

The object is achieved according to the invention in that the inflow port is arranged outside the output element and the drive element in the axial direction, and in that the working ports and the control port, depending on the position of the control piston within the valve housing, can be selectively connected to the inflow port or disconnected therefrom. In a concrete embodiment of the invention, it is provided that the working ports, the inflow port and the control port are configured as radial openings in the valve housing.

In this case the ports may be offset axially from one another and arranged in the sequence: inflow port, working port, outflow port, working port, control port, or: inflow port, control port, outflow port, working port, working port.

In a development of the invention, it is provided that a further outflow port is embodied on the valve housing as an axial port.

In addition, it may be provided that the control piston is configured to be hollow and that the interior of the control piston communicates with the inflow port in every position of the control piston relative to the valve housing.

In a concrete embodiment of the invention, it is proposed that the interior of the control piston can be connected to each of the working ports and to the control port by appropriate positioning of the control piston within the valve housing.

It may be provided that the control valve can adopt a first control position in which the first working port communicates exclusively with the outflow port, the second working port communicates exclusively with the inflow port and the control port communicates exclusively with the axial outflow port.

In a development of the invention, it is proposed that the control valve can adopt a second control position in which the first working port communicates exclusively with the outflow port, and the second working port and the control port communicate exclusively with the inflow port.

In this case it may be provided that the control valve can adopt a third control position in which the control port communicates exclusively with the inflow port while the working ports communicate neither with the inflow port nor with either of the outflow ports.

It is further proposed that the control valve can adopt a fourth control position in which the second working port communicates exclusively with the outflow port and the first working port and the control port communicate exclusively with the inflow port.

The device has an actuating device in the form of a hydraulic actuator and a hydraulic system which supplies the actuating device with pressure medium. The actuating device may be, for example, of the vane-cell or axial-piston type, as in the prior art. In the latter configuration a pressure piston which separates two pressure chambers from one another is displaced in an axial direction by the application of pressure medium. In this case the movement of the pressure piston causes a relative phase rotation between the output element and the drive element via two pairs of helical toothings. In addition, mechanical means (rotation angle limiting device) are provided to couple the output element to the drive element mechanically in a particular phase relation. The coupling may be such, for example, that the possible phase angles are limited to an angle range, or that a non-rotatable coupling between the output element and the drive element can be established in a defined phase relation. The rotation angle limiting device(s) may adopt a locked state (coupling established) and an unlocked state (no coupling). The transition from the locked to the unlocked state is effected by applying pressure medium to the rotation angle limiting device(s).

By charging one chamber or one group of pressure chambers with pressure medium while simultaneously discharging the other pressure chamber or pressure chambers, a phase adjustment of the inner rotor 23 relative to the outer rotor 22 is produced when the rotation angle limiting device(s) is/are in the unlocked state. In the locked state of the rotation angle limiting device(s), the phase adjustment takes place only within the range allowed by the rotation angle limiting device (s).

The hydraulic system has a control valve with a valve housing and a control piston. The valve housing may be configured to be substantially hollow-cylindrical. In this case the ports may be in the form of openings in the cylindrical surface. Within the valve housing a control piston can adopt a plurality of positions relative thereto, whereby a plurality of control positions can be realized. In this case it may be provided that the control piston can be displaced by means of an actuating unit relative to the valve housing in the axial direction thereof. The actuating unit may be, for example, of an electromagnetic or hydraulic type. In each control position a defined connection of the different ports is produced. The ports, in the form of openings in the lateral surface of the valve housing, are arranged offset to one another. The control piston and the valve housing can therefore be configured to be substantially rotationally symmetrical, whereby production can be considerably simplified.

The control piston has a plurality of control structures. There is provided a first control chamber which communicates, on the one hand, with the inflow port in all positions of the control piston and, on the other, can be connected to one of the working ports and to the control port (or the other working port). In this case there may be provided positions of the control piston in which the first control chamber communicates exclusively with the working port or the control port (or the other working port). In addition, there may be provided positions in which the first control chamber communicates with both ports. Through the activation of the working port and the control port (or the other working port) by means of a control chamber, the complexity of the control piston can be reduced. Fewer control elements are required, as a result of which costly machining thereof can be dispensed with and production costs can therefore be reduced. Furthermore, the reduction in the number of necessary control elements brings with it a reduction in the axial space requirement, so that use also as a central valve is possible. By virtue of a suitable arrangement on the valve housing of the control structures which cooperate with the first control chamber, the desired control logic of the control valve can be defined.

The control chambers may be configured, for example, as annular grooves in the outer lateral surface of the control piston. It would also be possible to form partial annular grooves.

The connection between the first control chamber and the inflow port may be effected via the interior of the hollow control piston. Pressure medium entering via the inflow port can reach the interior of the control piston via piston openings. In addition, there may be provided further piston openings which connect the first and/or the second control chamber to the interior of the piston.

Through the arrangement of the ports in the sequence: inflow port, working port (or control port), outflow port, working port, control port (or working port), the control valve may be provided for central valve applications. Because of the sequence of the ports, the pressure medium supply of the control valve can be arranged outside the actuating device. In this case the control valve projects from the inner rotor in the axial direction, the inflow port being located outside the inner rotor. The width of the inner rotor therefore needs to correspond only to the maximum distance between the working ports, the control port and the outflow port. The inner rotor, and therefore the actuating device, can therefore be made narrower. Furthermore, no pressure medium lines are required inside the inner rotor to conduct the pressure medium to the inflow port or ports, whereby the architecture of the actuating device is simplified and manufacturing costs are therefore reduced. The central valve solution leads to a more rigid hydraulic clamping of the vane in the pressure chamber.

It may be further provided that the control valve can adopt a first control position in which the working port communicates exclusively with the tank, the second working port communicates exclusively with the inflow port and the control port communicates exclusively with the tank. In addition, a second control position may be provided in which the first working port communicates exclusively with the tank and the second working port and the control port communicate exclusively with the inflow port. In addition, a third control position may be provided in which the control port communicates exclusively with the inflow port while the working ports communicate neither with the inflow port nor with either of the outflow ports. In addition, a fourth control position may be provided in which the second working port communicates exclusively with the tank and the first working port and the control port communicate exclusively with the inflow port.

Therefore, during starting of the internal combustion engine, in which the control valve adopts the first control position, the control port, and therefore the rotation angle limiting device(s), are connected to the tank. During the start, therefore, the coupling between inner rotor and outer rotor is ensured. Control positions two to four allow a phase adjustment in the direction of advanced or retarded timing, or a hydraulic fixing of the phase relation.

BRIEF DESCRIPTION OF THE DRAWINGS

Further features of the invention are apparent from the following description and from the drawings, in which an exemplary embodiment of the invention is represented in simplified form. In the drawings.

DETAILED DESCRIPTION OF THE DRAWINGS

Figure 1:
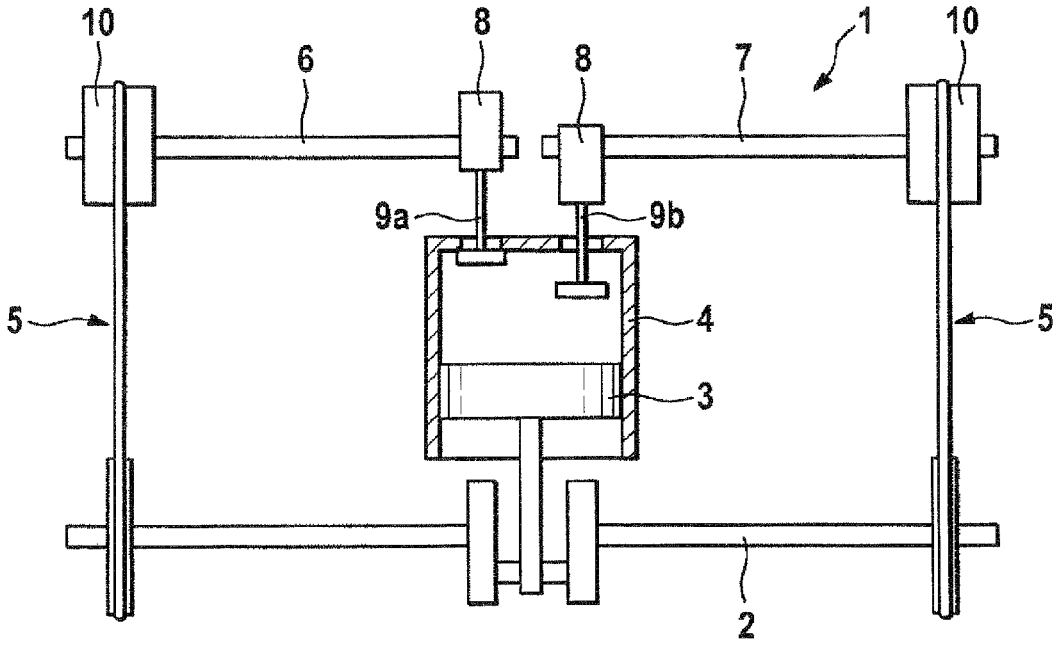
FIG. 1 shows an internal combustion engine only very schematically.

FIG. 1 shows a sketch of an internal combustion engine 1, a piston 3 mounted on a crankshaft 2 in a cylinder 4 being indicated. In the embodiment illustrated, the crankshaft 2 is connected to an inlet camshaft 6 and an exhaust camshaft 7 via a traction drive 5 in each case, it being possible for a first and second device 10 to induce relative rotation between crankshaft 2 and camshafts 6, 7. Cams 8 of the camshafts 6, 7 actuate one or more gas exchange inlet valves 9*a* and one or more gas exchange outlet valves 9*b*. It may also be provided that only one of the camshafts 6, 7 is provided with a device 10, or that only one camshaft 6, 7 equipped with a device 10 is provided.

Figure 2A:
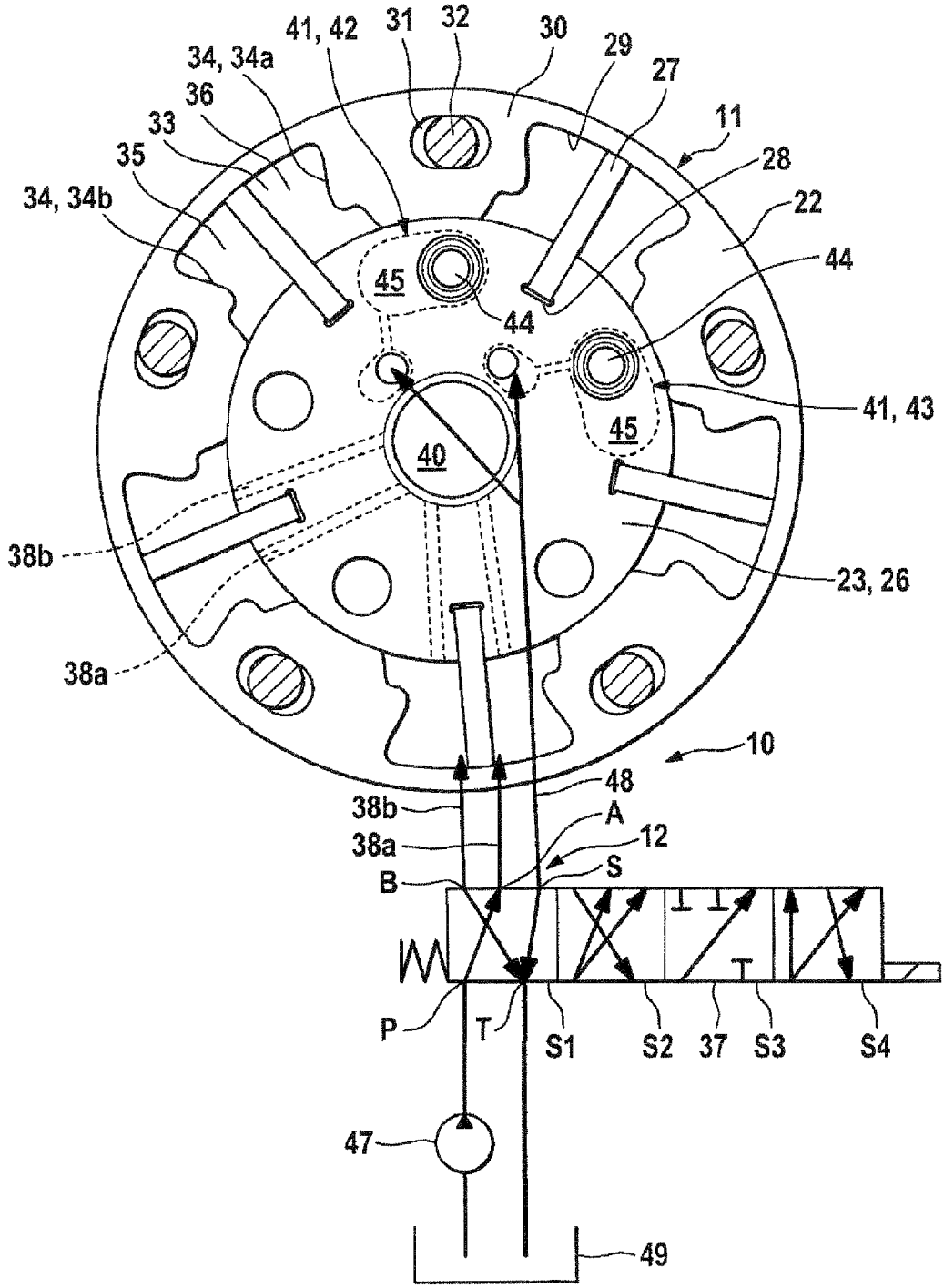
FIG. 2*a* is a top view of a device according to the invention for varying the timing control of gas exchange valves of an internal combustion engine with a hydraulic circuit, the control valve being represented only schematically.
Figure 2B:
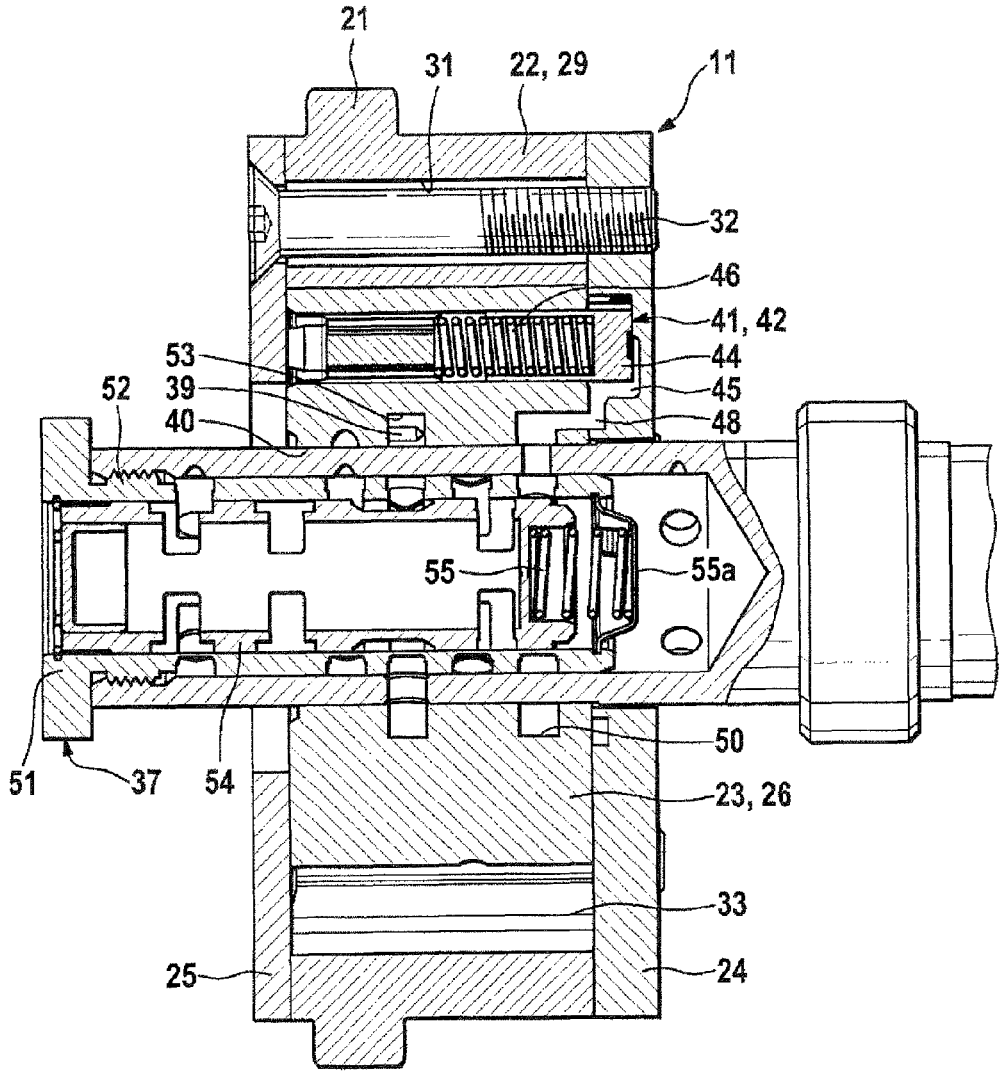
FIG. 2*b* shows a longitudinal section through the device of FIG. 2*a* along the line II B-II B, with the control valve.

FIGS. 2*a* and 2*b* show an embodiment of a device 10 according to the invention in a top view and in longitudinal section respectively.

The device 10 includes an actuating device 11 and a hydraulic system 12. The actuating device 11 has a drive element (outer rotor 22), an output element (inner rotor 23) which is connected non-rotatably to the camshaft 6, 7 and two side covers 24, 25. The inner rotor 23 is in the form of a vane wheel and has a substantially cylindrical hub element 26, from the outer cylindrical surface of which, in the embodiment shown, five vanes 27 extend outwardly in the radial direction. In this case the vanes 27 may be formed integrally with the hub element 26. Alternatively, the vanes 27 may be formed separately, as shown in FIG. 2*a*, and be arranged in axially extending vane grooves 28 formed on the hub element 26, the vanes 27 being subjected to a radially outwardly directed force by means of spring elements (not shown) arranged between the bases of the vane grooves 28 and the vanes 27.

Starting from an outer circumferential wall 29 of the outer rotor 22, a plurality of projections 30 extend radially inwards. In the embodiment illustrated, the projections 30 are formed integrally with the circumferential wall 29. Embodiments in which, instead of the projections 30, vanes mounted on the circumferential wall 29 and extending radially inwards are provided are, however, also possible. The outer rotor 22 is mounted rotatably relative to the inner rotor 23 on the inner rotor 23 by means of circumferential walls of the projections 30 located radially inwards.

Formed on an outer lateral surface of the circumferential wall 29 is a sprocket 21, by means of which torque can be transmitted from the crankshaft 2 to the outer rotor 22 via a chain drive (not shown). The sprocket 21 may be configured as a separate component and connected non-rotatably to the inner rotor 23, or may be formed integrally therewith. Alternatively, a belt drive or gear drive may be provided.

The side covers 24, 25 are arranged one on each of the axial side faces of the outer rotor 22 and fixed non-rotatably thereto. For this purpose an axial opening 31 is provided in each of the projections 30, a fastening element 32, for example a pin or a screw, passing through each axial opening 31, which fastening element 32 serves to fix the side covers 24, 25 non-rotatably to the outer rotor 22.

Inside the device 10 a pressure chamber 33 is formed between each two projections 30 adjacent in the circumferential direction, which pressure chamber 33 is delimited in the circumferential direction by opposite, substantially radially extending boundary walls 34 of adjacent projections 30, in the axial direction by the side covers 24, 25, radially inwards by the hub element 26 and radially outwards by the circumferential wall 29. Projecting into each of the pressure chambers 33 is a vane 27, the vanes 27 being configured in such a manner that they rest against both the side walls 24, 25 and the circumferential wall 29. Each vane 27 therefore divides the respective pressure chamber 33 into two counter-working pressure chambers 35, 36.

The outer rotor 22 is arranged to be rotatable within a defined angular range with respect to the inner rotor 23. The angular range is limited in one direction of rotation of the inner rotor 23 by the abutment of each vane 27 against a boundary wall 34 of the pressure chamber 33 configured as an advance stop 34*a* (advance timing control). Analogously, the angular range is limited in the other direction of rotation by the abutment of each vane 27 against the other boundary wall 34 of the pressure chamber 33, which serves as a retard stop 34*b* (retard timing control). Alternatively, a rotation limiting device, which limits the rotation angle range of the outer rotor 22 with respect to the inner rotor 23, may be provided.

By pressurizing one group of pressure chambers 35, 36 and depressurizing the other group, the phase relation of the outer rotor 22 with respect to the inner rotor 23, and therefore of the camshaft 6, 7 with respect to the crankshaft 2, can be varied. By pressurizing both groups of pressure chambers 35, 36, the phase relation of the two rotors 22, 23 with respect to one another can be maintained constant. Alternatively, it may be provided that neither of the pressure chambers 35, 36 is charged with pressure medium during phases of constant phase relation. The lubricating oil of the internal combustion engine 1 is generally used as the hydraulic pressure medium.

During starting of the internal combustion engine 1 or during idling phases, the pressure medium supply of the device 10 may not be sufficient to ensure hydraulic clamping of the vanes 27 inside the pressure chambers 33. In order to prevent uncontrolled oscillation of the inner rotor 23 with respect to the outer rotor 22, there is provided a locking mechanism 41 which establishes a mechanical connection between the two rotors 22, 23. The locking position may be located at one of the end positions of the inner rotor 23 relative to the outer rotor 22. In this case a rotation angle limiting device 42 is provided, a locking pin 44 being arranged in one of the rotors 22, 23 and a guide track 45 adapted to the locking pin 44 being arranged in the other rotor 22, 23. When the inner rotor 23 is in the locking position, the locking pin 44 can engage in the guide track 45 and thus establish a mechanical non-rotatable connection between the two rotors 22, 23.

It has proved advantageous to select the locking position such that, in the locked state of the device 10, the vanes 27 are located in a position between the advance stop 34*a* and the retard stop 34*b*. Such a locking mechanism 41 is shown in FIG. 2*a*. This mechanism consists of a first and a second rotation angle limiting device 42, 43. In the embodiment illustrated, each of the rotation angle limiting devices 42, 43 consists of an axially displaceable locking pin 44, each of the locking pins 44 being received in a bore of the inner rotor 23. In addition, two guide tracks 45 in the form of grooves extending in the circumferential direction are formed in the first side wall 24. These guide tracks 45 are indicated in FIG. 2*a* in the form of broken lines. Each of the locking pins 44 is loaded with a force in the direction of the first side cover 24 by means of a spring element 46. When the inner rotor 23 adopts a position with respect to the outer rotor 22 in which a locking pin 44 is opposite the associated guide track 45 in the axial direction, said locking pin 44 is forced into the guide track 45 and the respective rotation angle limiting device 42, 43 is switched from an unlocked to a locked state. In this case the guide track 45 of the first rotation angle limiting device 42 is configured such that the phase relation of the inner rotor 23 with respect to the outer rotor 22, with the first rotation angle limiting device 42 locked, is restricted to a range between a maximum retard position and the locking position. When the inner rotor 23 is in the locking position relative to the outer rotor 22, the locking pin 44 of the first rotation angle limiting device 42 rests against a stop formed in the circumferential direction by the guide track 45, whereby further adjustment in the direction of more advanced timing is prevented.

Analogously, the guide track 45 of the second rotation angle limiting device 43 is designed in such a manner that, with the second rotation angle limiting device 43 locked, the phase relation of the inner rotor 23 relative to the outer rotor 22 is restricted to a range between a maximum advance position and the locking position.

In order to switch the rotation angle limiting devices 42, 43 from the locked to the unlocked state, it is provided that the respective guide track 45 is charged with pressure medium. The respective locking pin 44 is thereby forced back into the bore against the force of the spring element 46 and the rotation angle limit is thus cancelled.

To supply the actuating device 11 with pressure medium, a plurality of pressure medium lines 38*a,b*, control lines 48, a control valve 37, a pressure medium pump 47 and a tank 49 are provided.

First and second pressure medium lines 38*a*, 38*b* are provided within the inner rotor 23. The first pressure medium line 38*a* extend, starting from the first pressure chambers 35, to a central receptacle 40 of the inner rotor 23. The second pressure medium line 38*b* likewise extend to the central receptacle 40, starting from the second pressure chambers 36. For reasons of clarity, the pressure medium lines 38*a,b* are shown for only two pressure chambers 33 in FIG. 2*a*.

To charge the rotation angle limiting devices 42, 43 with pressure medium, there are provided control lines 48 which, starting from a first annular groove 50 in the central receptacle 40 of the inner rotor 23, extend via the first side cover 24 to the guide tracks 45. In this case the first annular groove 50 communicates with the guide tracks 45 in all phase relations of the device 10.

Arranged within the receptacle 40 of the inner rotor 23 is a control valve 37. In the embodiment illustrated, the control valve 37 is received in a hollow camshaft 6, 7 which passes through the receptacle 40 of the inner rotor 23. In this case the inner rotor 23 is connected non-rotatably to the camshaft 6, 7, for example by means of a non-positive or material joint.

The control valve 37 has a first and a second working port A, B, an inflow port P, a third working port (control port S) and outflow ports T, $T_a$. Pressure medium can be supplied to the control valve 37 by a pressure medium pump 47 via the inflow port P. The first and second working ports A, B communicate respectively with the first and second pressure medium lines 38*a,b*. The control port S communicates with the control lines 48. Pressure medium can be discharged by the control valve 37 to a tank 49 via the outflow ports T, $T_a$.

In addition, the control valve 37 can be switched to four control positions S1-S4 (FIG. 2*a*). In the first control position S1 the second working port B communicates with the inflow port P, while both the first working port A and the control port S are connected to the outflow ports T, $T_a$. This control position S1 is adopted during the start phase of the internal combustion engine 1. In this phase the hydraulic clamping of the vanes 27 inside the pressure chambers 33 is generally not ensured because of insufficient system pressure. Because the guide tracks 45 of both rotation angle limiting devices 42, 43 are connected to the tank 49 via the control lines 48 and the control valve 37, both rotation angle limiting devices 42, 43 adopt the locked state. The inner rotor 23 is therefore connected mechanically to the outer rotor 22, whereby the phase relation is fixed in the locking position. Because the rotation angle limiting devices 42, 43 are connected not to the pressure medium pump 47 but to the tank 49 in this position of the control valve 37, there is no danger of unwanted unlocking. The starting ability of the internal combustion engine 1 is therefore ensured and at the same time exhaust gas emissions are reduced.

The control positions S2-S4 of the control valve 37 represent the regulating positions of the device 10 in which adjustment in the direction of retarded timing (second control position S2) or adjustment in the direction of advanced timing (fourth control position S4) is made, or the timing is maintained constant (third control position S3). In these control positions S2-S4 the guide tracks 45 of the rotation angle limiting devices 42, 43 are connected to the pressure medium pump 47 via the control lines 48 and the control valve 37. System pressure is therefore present at the end faces of the locking pins 44, as a result of which the rotation angle limiting devices 42, 43 adopt the unlocked state and allow a phase adjustment of the inner rotor 23 relative to the outer rotor 22.

In the second control position S2 both the second working port B and the control port S communicate with the inflow port P, while the first working port A is connected to the outflow port T. Pressure medium is therefore supplied by the pressure medium pump 47 to the second pressure chambers 36 via the control valve 37 and the second pressure medium lines 38*b*. At the same time, pressure medium is discharged from the first pressure chambers 35 via the first pressure medium lines 38*a* and the control valve 37 to the tank 49. The vanes 27 are therefore moved inside the pressure chambers 33 in the direction of the retard stops 34*b*. This results in a relative change of the phase relation of the camshaft 6, 7 with respect to the crankshaft 2 in the direction of retarded timing.

In the third control position S3 only the control port S communicates with the inflow port P, while the first and second working ports A, B are connected neither to the tank 49 nor to the outflow ports T, $T_a$. Pressure medium is therefore neither conducted to the pressure chambers 35, 36 nor discharged therefrom. The vanes 27 are hydraulically clamped, whereby the phase relation of the inner rotor 23 relative to the outer rotor 22, and therefore of the camshaft 6, 7 relative to the crankshaft 2, is fixed.

In the fourth control position S4, both the first working port A and the control port S communicate with the inflow port P, while the second working port B is connected to the outflow port T. Pressure medium is therefore supplied by the pressure medium pump 47 to the first pressure chambers 35 via the control valve 37 and the first pressure medium lines 38*a*. At the same time, pressure medium is discharged from the second pressure chambers 36 via the second pressure medium lines 38*b* and the control valve 37 to the tank 49. The vanes 27 are therefore moved within the pressure chambers 33 in the direction of the advance stops 34*a*. This results in a relative change of the phase relation of the camshaft 6, 7 with respect to the crankshaft 2 in the direction of advanced timing.

The control valve 37 is represented in FIGS. 3*a-d*. It consists of an actuating unit (not shown) and a hydraulic section 51. The hydraulic section 51 consists of a substantially hollow-cylindrical valve housing 52 and a control piston 54. The valve housing 52 has ports A, B, P, S, T, $T_a$. With the exception of the axial outflow port $T_a$, the ports A, B, P, S, T are in the form of openings in the cylindrical wall of the valve housing 52 which open into annular grooves formed in the outer lateral surface of the valve housing 52. The working ports A, B communicate via openings in the camshaft 6, 7 respectively with the first and second pressure medium lines 38*a, b*. The control port S communicates via openings in the camshaft 6, 7 with the first annular groove 50 of the inner rotor 23, into which the control lines 48 open.

The outflow port T communicates via further openings in the camshaft 6, 7 with the second annular groove 53, which is formed in the receptacle 40 of the inner rotor 23. In this case the second annular groove 53 is connected to the exterior of the actuating device 11 via an axial bore 39.

The ports A, B, P, S, T are offset axially from one another and arranged in the sequence: inflow port P, first working port A, outflow port T, second working port B, control port S. In this case, apart from the inflow port P, all the ports are arranged inside the receptacle 40 (FIG. 2*b*). The inflow port P projects from the actuating device 11 in the axial direction. As a result, the pressure medium can be supplied to the control valve 37 outside the actuating device 11. The need to provide a supply line, via which the pressure medium reaches the control valve 37, inside the inner rotor 23 is thus eliminated. The architecture of the inner rotor 23 is thereby considerably simplified.

The axial outflow port $T_a$ is embodied as an axial opening of the valve housing 52.

The control piston 54 has a substantially hollow-cylindrical configuration and is arranged axially displaceably within the valve housing 52. In this case, the axial position of the control piston 54 can be adjusted continuously by means of the actuating unit (not shown). The actuating unit acts against the force of a spring 55 which moves the control piston 54 to a starting position when the actuating unit is inactive. The spring 55 bears against a sheet-metal spring support 55*a* which is fastened in the axial opening that forms the axial outflow port $T_a$. The actuating unit 50 may be in the form, for example, of an electrical actuating unit.

The control piston 54 has four control chambers 56*a,b,c,d* spaced axially from one another. In the embodiment illustrated the control chambers 56*a,b,c,d* are in the form of annular grooves in the outer lateral surface of the control piston 54. With the exception of the fourth control chamber 56*d*, the control chambers 56*a,b,c* communicate with the interior of the control piston 54 via piston openings 57*a,b,c*. The control chambers 56*a-d* are each delimited by two annular webs 58*a-e*. Here, the first annular web 58*a* delimits the first control chamber 56*a* in the direction of the axial outflow port $T_a$ and the fifth annular web 58*e* delimits the inflow port P in the direction of the actuating unit (not shown). The second annular web 58*b* separates the first control chamber 56*a* from the fourth control chamber 56*d*. The third annular web 58*c* separates the fourth control chamber 56*d* from the second control chamber 56*b*. The fourth annular web 58*d* separates the second control chamber 56*b* from the third control chamber 56*c*.

Depending on the relative position of the control piston 54 in relation to the valve housing 52, the control chambers 56*a-d* communicate with different ports A, B, P, S, T, $T_a$.

The first control chamber 56*a* is arranged in such a manner that communication can be established with the second working port B and the control port S.

The second control chamber 56*b* is arranged in such a manner that communication can be established with the first working port A.

The third control chamber 56*c* communicates with the inflow port P in all positions of the control piston 54.

The fourth control chamber 56*d* is arranged in such a manner that communication can be established with the second working port B or with the first working port A. In this case the fourth control chamber 56*d* always communicates with the outflow port T.

Figure 3A:
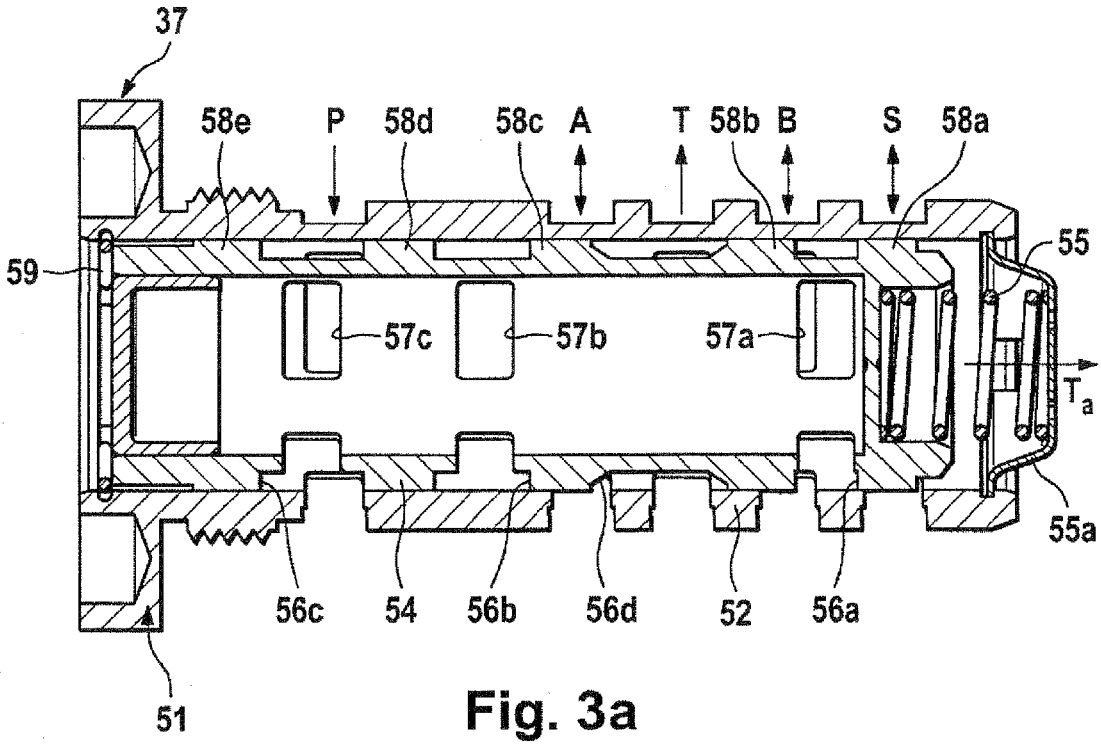
FIGS. 3*a*-3*d* each show longitudinal sections through the control valve of FIG. 2*b* in different control positions thereof.

The operation of the control valve 37 is explained with reference to FIGS. 3*a-d*. The figures differ with regard to the relative position of the control piston 54 in relation to the valve housing 52. In FIG. 3*a* the control valve 37 is shown in a state in which the actuating unit is inactive. The spring 55 urges the control piston 54 to the starting position in which it rests against a first stop 59. In the following FIGS. 3*b-c* the control piston 54 is offset relative to the valve housing 52 by an increasing travel distance against the force of the spring 55.

In the state of the control valve 37 represented in FIG. 3*a*, pressure medium reaches the interior of the control piston 54 via the inflow port P, the third control chamber 56*c* and the third piston openings 57*c*. From there, the pressure medium reaches the second working port B via the first piston openings 57*a* and the first control chamber 56*a*. At the same time, a pressure medium flow to the control port S and the first working port A is blocked by the second and third annular webs 58*b,c* respectively. The first working port A is connected by means of the fourth control chamber 56*d* to the outflow port T, and the control port S is connected to the axial outflow port $T_a$.

Consequently, pressure medium from the pressure medium pump 47 reaches the second pressure chambers 36 via the control valve 37, while pressure medium is discharged to the tank 49 from the guide tracks 45 and the first pressure chambers 35. The rotation angle limiting devices 42, 43 are therefore in the locked state and thus prevent a phase adjustment of the inner rotor 23 relative to the outer rotor 22.

Figure 3B:
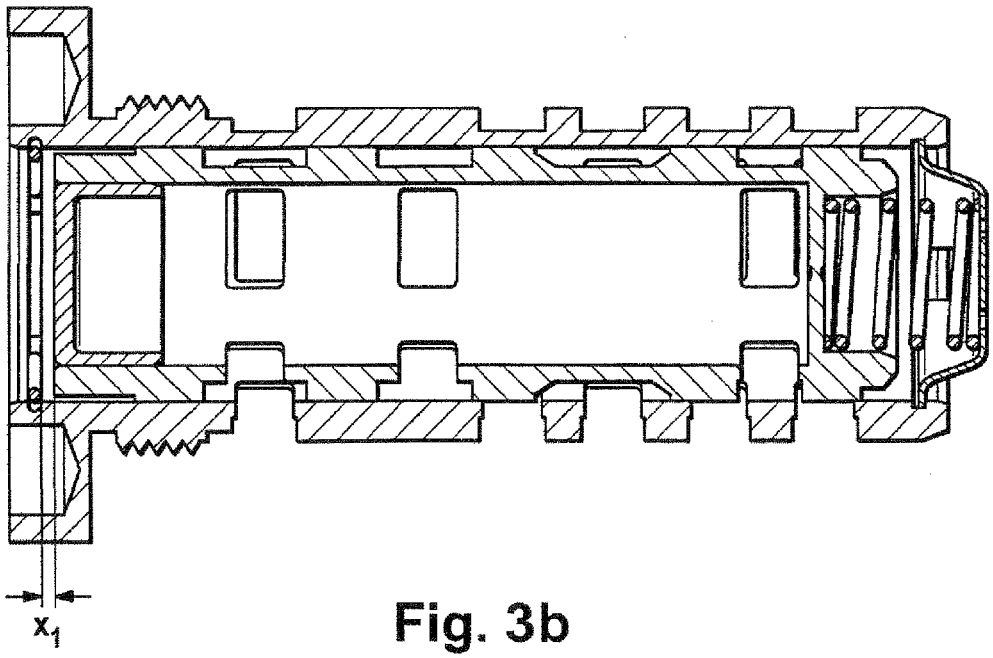

In FIG. 3*b* the control piston 54 has been displaced by the distance $x_1$ relative to the valve housing 52 against the force of the spring 55. Pressure medium which is supplied to the control valve 37 via the inflow port P reaches the first control chamber 56*a* via the interior of the control piston 54, and from there reaches the second working port B and the control port S. At the same time a pressure medium flow to the first working port A is blocked by the third annular web 58*c*. The first working port A continues to be connected to the outflow port T by means of the fourth control chamber 56*d*. The first annular web 58*a* separates the control port S from the axial outflow port $T_a$.

Consequently, pressure medium from the pressure medium pump 47 reaches the second pressure chambers 36 and the guide tracks 45 via the control valve 37, while pressure medium is discharged to the tank 49 from the first pressure chambers 35.

The rotation angle limiting devices 42, 43 are therefore switched to the unlocked state. At the same time, a phase adjustment in the direction of retarded timing takes place as a result of the pressure medium flow to the second pressure chambers 36 and the pressure medium discharge from the first pressure chambers 35.

Figure 3C:
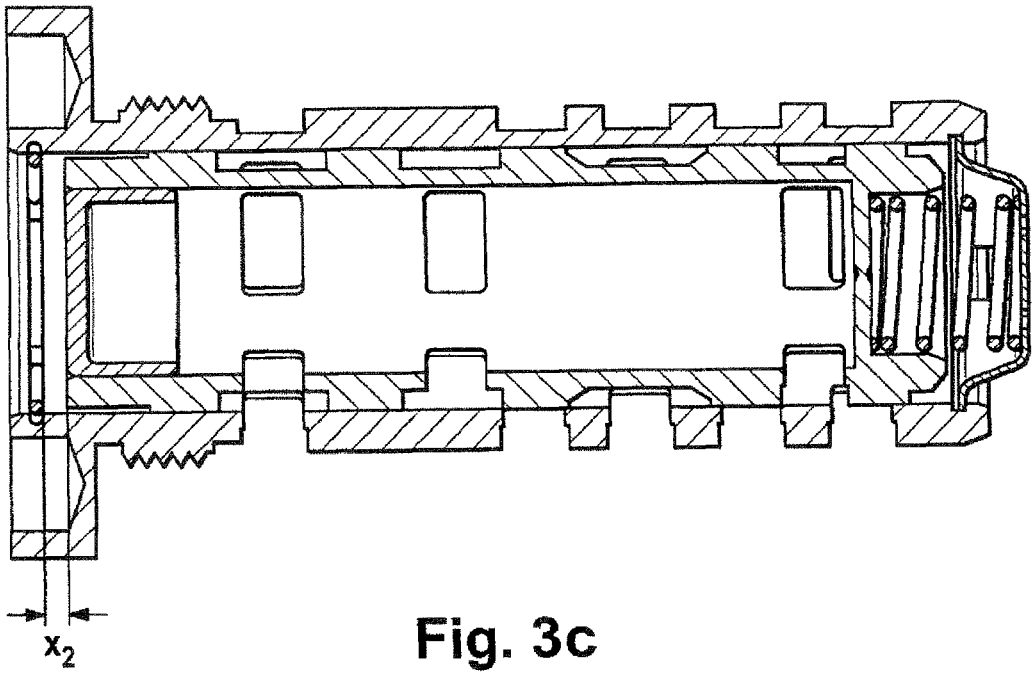

In FIG. 3*c* the control piston 54 has been displaced by the distance $x_2>x_1$ relative to the valve housing 52 against the force of the spring 55. Pressure medium which is supplied to the control valve 37 via the inflow port P reaches the first control chamber 56*a* via the interior of the control piston 54, and from there reaches the control port S. At the same time a pressure medium flow to the two working ports A, B is blocked by the second and third annular webs 58*b,c* respectively. At the same time, the second and third annular webs 58*b,c* block the connection between each of the working ports A, B and the outflow port T. The first annular web 58*a* continues to separate the control port S from the axial outflow port $T_a$.

Consequently, pressure medium from the pressure medium pump 47 reaches the guide tracks 45 via the control valve 37, while pressure medium is neither supplied to the pressure chambers 35, 36 nor discharged therefrom. The actuating device 11 is therefore clamped hydraulically; that is to say, no phase adjustment takes place between the inner rotor 23 and the outer rotor 22.

Figure 3D:
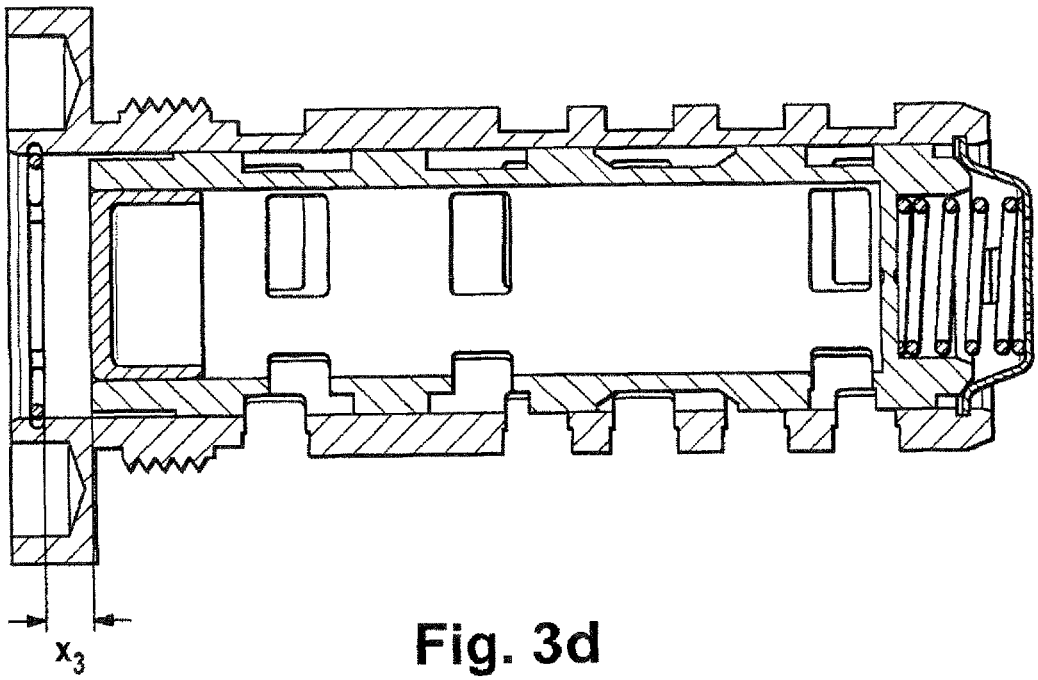

In FIG. 3*d* the control piston 54 has been displaced by the distance $x_3>x_2$ relative to the valve housing 52 against the force of the spring 55. Pressure medium which is supplied to the control valve 37 via the inflow port P reaches the first control chamber 56*a* via the interior of the control piston 54, and from there reaches the control port S. At the same time, the pressure medium reaches the second control chamber 56*b* via the interior of the control piston 54 and the second piston openings 57*b*, and from there reaches the first working port A. A connection between the inflow port P and the second working port B is blocked by the second annular web 58*b*. Likewise, a pressure medium flow from the first working port A to the outflow port T is blocked by the third annular web 58*c*. The second working port B is connected to the outflow port T by means of the fourth control chamber 56*d*. The first annular web 58*a* continues to separate the control port S from the axial outflow port $T_a$.

Consequently, pressure medium from the pressure medium pump 47 reaches the first pressure chambers 35 and the guide tracks 45 via the control valve 37, while pressure medium is discharged from the second pressure chambers 36 to the tank 49.

The rotation angle limiting devices 42, 43 are therefore switched to the unlocked state. At the same time, a phase adjustment in the direction of retarded timing takes place as a result of the pressure medium flow to the first pressure chambers 35 and the pressure medium discharge from the second pressure chambers 36.

The control valve 37 illustrated serves, firstly, to regulate the phase relation of the inner rotor 23 relative to the outer rotor 22. In addition, the locking states of the rotation angle limiting devices 42, 43 can be controlled by a separate control port S. By way of the separation of the control port S from the working ports A, B, the danger of unwanted locking or unlocking of the rotation angle limiting devices 42, 43 is reduced. In addition, the control logic regarding the control port S can be executed independently of those of the working ports A, B, and can therefore be tailored to the particular application. As a result of the pressure medium supply to one of the working ports B and to the control port S via a common control chamber 56*a*, the structure of the control piston 54 is simplified. Instead of the five or six control chambers required in the prior art, the control valve 37 has only four control chambers 56*a-d* while having the same functionality. This leads to a significant simplification of the control piston 54. Furthermore, the number of control edges (boundaries of the control chambers 56*a-d*), which are complex to produce, is reduced to a minimum. The control piston 54 can therefore be produced at lower cost and with greater process reliability. In addition, the control piston 54 can be designed shorter in the axial direction, considerably reducing the space requirement of the control valve 37, which is located in space-critical regions of the internal combustion engine 1. This applies both to embodiments as a plug-in valve (control valve 37 arranged outside the actuating device 11), in which the actuating unit and the hydraulic section 51 are connected to one another, and to central valve applications (FIG. 2*b*), in which the hydraulic section 51 is embodied separately from the actuating unit and is arranged in the receptacle 40 of the actuating unit 11.

Embodiments in which the first working port A and the control port S are reversed are also possible.

Reference Symbols

1 Internal combustion engine
2 Crankshaft
3 Piston
4 Cylinder
5 Traction drive
6 Inlet camshaft
7 Exhaust camshaft
8 Cam
9*a* Inlet gas exchange valve
9*b* Outlet gas exchange valve
10 Device
11 Actuating device
12 Hydraulic system
21 Sprocket
22 Outer rotor
23 Inner rotor
24 Side cover
25 Side cover
26 Hub element
27 Vane
28 Vane grooves
29 Circumferential wall
-
31 Axial opening
32 Fastening element
33 Pressure chamber
34 Boundary wall
34*a* Advance stop
34*b* Retard stop
35 First pressure chamber
36 Second pressure chamber
37 Control valve
38*a* First pressure medium line
38*b* Second pressure medium line
39 Axial bore
40 Receptacle
41 Locking mechanism
42 Rotation angle limiting device
43 Rotation angle limiting device
44 Locking pin
45 Guide track
46 Spring element
47 Pressure medium pump
48 Control line
49 Tank
50 First annular groove
51 Hydraulic section
52 Valve housing
53 Second annular groove
54 Control piston
55 Spring
55*a* Sheet-metal spring support
56*a* First control chamber
56*b* Second control chamber
56*c* Third control chamber
56*d* Fourth control chamber
57*a* First piston opening
57*b* Second piston opening
57*c* Third piston opening
58*a* First annular web
58*b* Second annular web
58*c* Third annular web
58*d* Fourth annular web
58*e* Fifth annular web
59 Stop
A First working port
B Second working port
P Inflow port
S Control port
T Outflow port
$T_a$ Axial outflow port
$x_1$-$x_4$ Displacement
S1 First control position
S2 Second control position
S3 Third control position
S4 Fourth control position

The invention claimed is:

1. A device for variably adjusting timing control of gas exchange valves of an internal combustion engine, comprising:

a drive element;

an output element;

a rotation angle limiting device;

a control valve; and at least two counter-working pressure chambers it being possible to bring about a phase adjustment between the output element and the drive element by charging one of the pressure chambers with pressure medium while simultaneously discharging the other of the pressure chambers, the rotation angle limiting device preventing a phase relation from being altered when in a locked state, the rotation angle limiting device allowing the phase relation to be altered when in an unlocked state, it being possible to switch the rotation angle limiting device from the locked state to the unlocked state by charging same with pressure medium, the control valve comprising a valve housing and a control piston, exactly one inflow port, at least one outflow port, a control port and two working ports being embodied on the valve housing, the inflow port being connected to a pressure source, the outflow port being connected to a tank, the control port being connected to the rotation angle limiting device and the working ports each being connected to a respective pressure chamber, and the control valve being arranged in a central receptacle of the output element, wherein the inflow port is arranged outside the output element and the drive element in an axial direction, the working ports and the control port can he selectively connected to or disconnected from the inflow port, depending on a position of the control piston within the valve housing, and the control piston comprises a first control chamber arranged and dimensioned so that communication can be established with the control port and the second working port, a second control chamber arranged and dimensioned so that communication can be established with the second working port, a third control chamber arranged and dimensioned to communicate with the inflow port in all positions of the control piston, and a fourth control chamber arranged and dimensioned so that communication can be established with the second working port or the first working port.

2. The device of claim 1, wherein the working ports, the inflow port and the control port are radial openings in the valve housing.

3. The device of claim 1, wherein the working ports, the inflow port, the control port and the outflow port are offset axially from one another and are arranged in the following sequence: inflow port, working port, outflow port, working port, control port or inflow port, control port, outflow port, working port, working port.

4. The device of claim 1, wherein the control piston is configured to he hollow and an interior of the control piston communicates with the inflow port in all positions of the control piston relative to the valve housing.

5. The device of claim 4, wherein the interior of the control piston can be connected to each of the working ports and to the control port by appropriate positioning of the control piston within the valve housing.

6. The device of claim 4, wherein a further outflow port is embodied as an axial port on the valve housing.

7. The device of claim 6, wherein the control valve can adopt a first control position in which the control port communicates exclusively with the inflow port while the working ports communicate neither with. the inflow port nor with the outflow port.

8. The device of claim 7, wherein the control valve can adopt a second control position in which the first working port communicates exclusively with the outflow port, the second working port communicates exclusively with the inflow port, and the control port communicates exclusively with the axial outflow port.

9. The device of claim 8, wherein the control valve can adopt a third control position in which the first working port communicates exclusively with the outflow port and the second working port and the control port communicate exclusively with the inflow port.

10. The device of claim 9, wherein the control valve can adopt a fourth control position in which the second working port communicates exclusively with the outflow port and the first working port and the control port communicate exclusively with the inflow port.

11. The device of claim 1, wherein the fourth control chamber is always in communication with the outflow port.

* * * * *

UNITED STATES PATENT AND TRADEMARK OFFICE

CERTIFICATE OF CORRECTION

PATENT NO. : 8,522,733 B2
APPLICATION NO. : 12/746266
DATED : September 3, 2013
INVENTOR(S) : Hoppe et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 271 days.

Signed and Sealed this
Fifteenth Day of September, 2015

Michelle K. Lee

Michelle K. Lee
*Director of the United States Patent and Trademark Office*